United States Patent [19]

Barbezat et al.

[11] Patent Number: 4,771,524

[45] Date of Patent: Sep. 20, 1988

[54] ROLL HAVING A HARD ENVELOPE SURFACE

[75] Inventors: Gerard Barbezat, Zell; Heinz Luscher, Elsau, both of Switzerland

[73] Assignee: Sulzer Brothers Limited, Winterthur, Switzerland

[21] Appl. No.: 10,395

[22] Filed: Feb. 3, 1987

[30] Foreign Application Priority Data

Feb. 14, 1986 [CH] Switzerland ..... 612/86

[51] Int. Cl.[4] ..... B31B 31/08

[52] U.S. Cl. ..... 29/132; 29/110

[58] Field of Search ..... 29/132, 130, 125, 110; 148/3; 164/58.1, 57.1

[56] References Cited

U.S. PATENT DOCUMENTS

| | | | |
|---|---|---|---|
| 3,997,370 | 12/1976 | Horvath, Jr. et al. | 29/132 |
| 4,165,407 | 8/1979 | Endoh et al. | 29/132 |
| 4,546,527 | 10/1985 | Fukuda et al. | 29/130 |
| 4,697,320 | 10/1987 | Ishihara et al. | 29/132 |
| 4,721,153 | 1/1988 | Sano et al. | 29/132 |
| 4,726,417 | 2/1988 | Sano | 29/132 |

FOREIGN PATENT DOCUMENTS

| | | | |
|---|---|---|---|
| 0127748 | 10/1981 | Japan | 29/132 |
| 0001772 | 1/1984 | Japan | 29/132 |
| 0043428 | 3/1985 | Japan | 29/132 |
| 0099408 | 6/1985 | Japan | 29/132 |
| 1147815 | 7/1986 | Japan | 29/132 |
| 0053409 | 11/1986 | Japan | 29/132 |

*Primary Examiner*—P. W. Echols
*Assistant Examiner*—Irene Cuda
*Attorney, Agent, or Firm*—Kenyon & Kenyon

[57] ABSTRACT

To increase abrasion resistance, a cast-iron roll is given a carbidic running-surface layer which has a defined depth of at least 1 mm and a fine-grained structure whose cementite dendrites have a length of at most 100 μm and a thickness of at most 20 μm. The fine-grained structure is produced by remelt hardening of the outer surface of the roll.

8 Claims, No Drawings

ROLL HAVING A HARD ENVELOPE SURFACE

This invention relates to a roll having a hard envelope surface and a process of making the roll. More particularly, this invention relates to a roll for a papermaking machine having a hard outside surface.

As is known, various types of rolls have been used in environments which require the rolls to have a hard envelope surface. For example, the rolls of papermaking machines which are used for smoothing, drying and creping a web of paper require hard running surfaces since these rolls are usually subjected to large forces and experience heavy wear.

In many cases, the rolls or roll shells of the above type are produced as clear chilled castings in molds in which a chill casting surface layer with a carbide structure produced by chilling of the mold arises on the outside of a lamellar graphite cast iron core which solidifies as gray cast iron because of a relatively slow cooling.

Because cooling rates differ, three discrete zones having different structures arise:

(a) a gray cast iron core zone in which the carbon has separated out mainly as graphite, namely lamellar graphite; the structure in this zone is perlitic;

(b) a transitional or mottled zone of white and gray cast iron in which the proportion of white (carbidic) cast iron decreases continuously towards the inside and the separation as lamellar graphite increases correspondingly; the extent and nature of this transitional zone vary within wide limits and escape arbitrary control;

(c) a chilled zone in which the carbon has been completely bound as carbide; this zone has a coarse structure containing cementite dendrites whose length is mainly 200 μm and whose thickness is mainly more than 50 μm. Dendrite orientation is relatively random; the coarse structure impairs abrasion resistance.

Since defined chill cast layers are difficult to achieve in clear chill casting, rolls of the kind requiring a hard envelope cannot be produced from spheroidal graphite or vermicular graphite cast iron.

Accordingly, it is an object of the invention to provide a roll having a hard envelope with a relatively high degree of abrasion resistance and with reduced grain sizes in a carbidic structure.

It is another object of the invention to provide an economical process of making rolls with running surface of high abrasion resistance.

It is another object of the invention to provide a roll with a carbidic structure of defined depth at an outer surface.

Briefly, the invention provides a roll made of gray cast iron with a hard outside running surface which has a carbidic structure having a defined reference depth of at least one millimeter and with cementite dendrites having a maximum length of 100 μm and a maximum thickness of 20 μm.

The term "defined" reference depth is intended to denote such depths of the layer having a carbidic structure which vary by not more than ±10% from their reference value over the whole running surface of the roll.

The term "rolls" is intended in the present case to denote solid rolls and hollow rolls and particularly rolls that can be used in papermaking machines, for example, for smoothing, drying and creping a web of paper. If necessary, the rolls can be heated or cooled for these uses. The linear force pattern along a gap between a roll and, for example, another roll can be controlled along the roll length by variable internal or external forces.

The invention also provides a process for the production of a roll with a hard running surface. In accordance with the process, a cast iron melt is first teemed into a sand mold to form a roll. The roll is then preheated from the cast state and the preheated running surface is then rapidly heated to above the liquidus temperature to melt the running surface of the roll locally, for example in a stepwise progressive manner in the circumferential and axial directions, to the intended reference depth, i.e. of at least one millimeter. The remelted running surface is then solidified by an immediately subsequent rapid cooling below the $Ar_1$ point of the iron-carbon diagram, whereafter the roll is cooled to ambient temperature.

The rapid heating of the preheated running surface to at least the liquidus temperature of the case iron used i.e., to at least approximately 1200° C.—and the subsequent rapid solidification and cooling to below the $Ar_1$ point of the iron-carbon-diagram—i.e., to below 730° C.—produces on the running surface a fine carbidic and, more particularly, a ledeburitic structure whose cementite dentrites do not exceed the above noted maximum dimensions. The point is that the treatment dissolves the carbon in the melted zone, the carbon subsequently crystallizing as iron carbide because of the high solidification and cooling rates.

Towards the interior of the roll body, the carbidic layer is followed by a heat-influenced zone which can be considered to have a fine-perlitic bainitic quenched and tempered structure. The thickness of this latter zone corresponds at least approximately to the thickness of the preceding carbidic layer.

The required remelt depth can be achieved only if the wall thickness is at least 5 times the remelt depth, otherwise sufficiently rapid cooling and solidification of the melted depth zone becomes uncertain.

Since the depth of the melted zone in the remelting of the surface can be determined and observed relatively accurately, the required reference depth can be ensured over the entire surface to the required accuracy and with the required uniformity.

To reduce the risk of cracking, particularly in the transition zone between the layer of the running surface and the roll body or core unaffected by remelting, the maximum reference depth of the carbidic structure is, with advantage, 8 millimeters (mm). This maximum reference depth makes economic sense since it can be achieved with cooling conditions that are not particularly expensive.

The rolls which are produced have a minimum diameter of 200 millimeters and a minimum wall thickness of 20 millimeters.

Very advantageously, the roll is made of spheroidal graphite cast iron and has the following composition (in weight %):

| | |
|---|---|
| C | 2.3–3.8 |
| Si | 1–3 |
| Mn | 0.1–1 |
| P (max) | 0.08 |
| S (max) | 0.01 |
| Mg | 0.03–0.08 |
| Fe | Remainder |

The point is that the modulus of elasticity important for rigidity is the same over the whole roll cross-section including the carbidic layer and is, for example, approximately 160 000 to 170 000 N/mm$^2$. In contrast to this, in previously known rolls, the modulus of elasticity in the carbidic layer is equally high, but drops continuously in the mottled zone in dependence upon graphite content and is only about 100 000 to 120 000 N/mm$^2$ in the gray zone. Also, spheroidal graphite cast iron has the further advantage of increased fatigue strength over con-ventional gray cast iron.

Of course, the rolls can be made of vermicular graphite cast iron or lamellar graphite cast iron. In this case, the following composition (in weight %) has been found advantageous for rolls having segregations of vermicular graphite:

| | |
|---|---|
| C | 2.8–3.6 |
| P (max) | 0.06 |
| Si | 1–3 |
| Mn | 0.1–1 |
| S (max) | 0.06 |
| Mg | 0.01–0.04 |
| Fe | Remainder |

For roll bodies made of conventional cast iron—i.e., of lamellar graphite cast iron—the following composition (in weight %) has proved advantageous:

| | |
|---|---|
| C | 2.8–3.6 |
| P | 0.01–0.5 |
| S (max) | 0.1 |
| Si | 0.5–3 |
| Mn | 0.2–1 |
| Fe | Remainder |

Other roll properties such as tensile strength and fatigue strength can be improved in all three kinds of graphite segregations if the cast iron also contains at least one of the following alloy elements (in weight %):

| | |
|---|---|
| Ni | 0.1–3 |
| Cu | 0.1–2 |
| Mo | 0.1–1 |
| Sn | 0.01–0.2 |
| Cr | 0.01–0.4 |
| B | 0.01–0.1 |

Since the roll surface requires machining after remelt hardening, the minimum depth of the melted and carbidically solidified running-surface zone must be—before such machining—approximately 1 millimeter (mm) more than the required reference depth.

Advantageously, in the production process described, preheat temperatures of from 450° to 600° C. and heating rates of at most 100° C./hour are maintained and/or the cooling to ambient temperature after remelting proceeds at a maximum rate of 50° C./hour. Conveniently, the latter cooling treatment can be performed in a furnace.

The energy source for the melting operation can be provided by electric arcs. In this event, welding torches, particularly those which have a tungsten electrode and operate, for example, at an energy density of 2 to 4 kW/cm$^2$, are particularly suitable because of their relatively simple handling and for economic reasons. Since the melting proceeds ad-vantageously in a protective gas atmosphere, the energy source used is preferably in the form of TIG (tungsten inert gas) welding torches. However, the melting can be performed by means of laser or electron beams.

The rapid cooling to temperatures below 730° C. proceeds in still air. As previously stated, the minimum wall thickness specified ensures that heat is removed fast enough. The simplest way of achieving the stepwise advance of local melting is by a rotating and/or longitudinal relative movement between the torch and the preheated roll. It has been found convenient, in this case, to rotate the roll around the stationary torch while advancing axially in steps.

Conveniently, to achieve a flaw-free running surface having a carbidically solidified structure, the roll is treated mechanically to remove any casting skin before treatment. After the treatment, the running surface is finish-machined conventionally, as previously stated, with carbidic running surfaces of from 1 to 8 millimeters (mm) then arising.

The following is one example of a roll shell made in accordance with the invention.

A roll shell of 400 mm outer diameter and 70 mm wall thickness, made of spheroidal graphite cast having the following chemical composition (in weight %):

| | |
|---|---|
| C | 3.4 |
| Si | 2.4 |
| P | 0.2 |
| S | 0.1 |
| Mn | 0.2 |
| Cu | 1 |
| Mg | 0.04 |
| Fe | Remainder |

is cast as a sand casting in a sand mold. While in the cast state, the shell is initially preheated by a gas torch to a preheat temperature of 500° C. while slowly rotating. Next, the shell is rapidly heated by means of a TIG welding torch having a tungsten electrode of 3.2 mm diameter which is fixedly disposed opposite the outer periphery of the shell. The roll shell surface moves past the electrode at a speed of approximately 15 cm/min, a voltage U of 20.5 V between the electrode and the workpiece giving rise to an arc in which a current I of approximately 200 A flows. A helium flow of 7 l/min from the torch maintains the melt zone of the torch arc in a protective gas atmosphere.

Immediately after the torch, the molten zone cools immediately below the $Ar_1$ point of the iron-carbon diagram.

After completion of the remelting, the roll shell is 13 heated in a furnace preheated to 500° C., then cooled slowly at a maximum cooling rate of 50° C./hour.

In the present example, this leads to a remelt depth of approximately 6 millimeters (mm).

Of note, all percentages indicating concentrations of compositions of material are to be understood as being in weight %.

The invention thus provides a roll with a hard envelope surface which is characterized in having an improved abrasion resistance as well as a fine grained structure wherein the dendrites are of limited size.

The invention also provides a relatively economical process for producing a hard layer on the running surface of a cast roll as well as a process which can use spheroidal graphite or vermicular graphite cast iron to make the roll.

What is claimed is:

1. A roll more particularly for a papermaking machine, having a hard envelope surface and a minimum diameter of 200 millimeters and a minimum wall thickness of 20 millimeters, said roll being made of gray cast iron having an outside running surface with a carbidic structure having a defined reference depth of at least 1 millimeter with cementite dendrites of a maximum length of 100 μm and a maximum thickness of 20 μm therein.

2. A roll as set forth in claim 1 wherein said maximum reference depth of the carbidic structure is 8 millimeters.

3. A roll as set forth in claim 1 which is made of spheroidal graphite cast iron having the following composition in weight %:

| | |
|---|---|
| C | 2.3–3.8 |
| Si | 1–3 |
| Mn | 0.1–1 |
| P (max) | 0.08 |
| S (max) | 0.01 |
| Mg | 0.03–0.08 |
| Fe | Remainder |

4. A roll as set forth in claim 1 made of vermicular graphite cast iron and having the following composition in weight %:

| | |
|---|---|
| C | 2.8–3.6 |
| P (max) | 0.06 |
| Si | 1–3 |
| Mn | 0.1–1 |
| S (max) | 0.06 |

-continued

| | |
|---|---|
| Mg | 0.01–0.04 |
| Fe | Remainder |

5. A roll as set forth in claim 1 made of lamellar graphite cast iron and having the following composition in weight %:

| | |
|---|---|
| C | 2.8–3.6 |
| P | 0.01–0.5 |
| S (max) | 0.1 |
| Si | 0.5–3 |
| Mn | 0.2–1 |
| Fe | Remainder |

6. A roll according to any one of claims, 3, 4, and 5 wherein the cast iron contains at least one of the following alloy elements in weight %:

| | |
|---|---|
| Ni | 0.1–3 |
| Cu | 0.1–2 |
| Mo | 0.1–1 |
| Sn | 0.01–0.2 |
| Cr | 0.01–0.4 |
| B | 0.01–0.1 |

7. A roll made of gray cast iron with a hard outer surface having a fine grained carbidic structure of a reference depth of from 1 millimeter to 8 millimeters and with cementite dendrites therein of a maximum length of 100 μm and a maximum thickness of 20 μm.

8. A roll as set forth in claim 7 having a maximum diameter of 200 millimeters and a minimum wall thickness of 20 millimeters.

* * * * *

UNITED STATES PATENT AND TRADEMARK OFFICE

CERTIFICATE OF CORRECTION

PATENT NO. : 4,771,524

DATED : September 20, 1988

INVENTOR(S) : GERARD BARBEZAT, et al

It is certified that error appears in the above-identified patent and that said Letters Patent is hereby corrected as shown below:

Column 2, line 25 "dentrites" should be -dendrites-
Column 3, line 67 "ad-vantageously" should be -advantageously-
Column 4, line 23 "cast having" should be -cast iron having-
Column 4, line 51 delete "13"
Column 5, line 2 "roll more" should be -roll, more- Signed and Sealed this Fourteenth Day of March, 1989

*Attest:*

*Attesting Officer*

DONALD J. QUIGG

*Commissioner of Patents and Trademarks*